United States Patent [19]

Lyle et al.

[11] 4,114,611

[45] Sep. 19, 1978

[54] TRACTION DEVICE

[76] Inventors: Judge M. Lyle, 3901 Westcliff Rd. South, Fort Worth, Tex. 76109; Jon W. Eberle, 7715 Rolling Acres, Dallas, Tex. 75248

[21] Appl. No.: 795,326

[22] Filed: May 9, 1977

[51] Int. Cl.[2] ..... A61H 1/02

[52] U.S. Cl. ..... 128/75; 128/84 C

[58] Field of Search ..... 128/75, 84 R, 84 C

[56] References Cited

U.S. PATENT DOCUMENTS

| | | | |
|---|---|---|---|
| 1,070,467 | 8/1913 | Heggen | 128/84 R |
| 2,815,022 | 12/1957 | Krumm | 128/84 R |
| 3,105,489 | 10/1963 | Zivi | 128/75 |
| 3,413,971 | 12/1968 | Evans | 128/75 |
| 3,750,658 | 8/1973 | Dawson, Jr. et al. | 128/75 |
| 3,762,403 | 10/1973 | Raban | 128/75 |
| 3,915,161 | 10/1975 | Shields | 128/75 |

*Primary Examiner*—John D. Yasko

*Attorney, Agent, or Firm*—Wofford, Felsman, Fails & Zobal

[57] ABSTRACT

A portable traction device suitable for hospital, office, or home use. The device comprises a frame adapted to fit about a patient while lying down. The frame has two telescoping side members and two end members, the latter of which have connecting means adapted to be coupled to the patient's body at two different positions. Springs bias the telescoping members outward to apply traction to the patient's body. An arrangement is provided for varying the traction depending upon the need. In addition, a quick release device operable by the patient is provided to release the traction.

2 Claims, 4 Drawing Figures

21
23
25
27
29
31
31A
31B
33
33A
35
35A
35B
37
37A
39
41
43
45
47
49
51
63
65
67
69
71
73
75
77
81
83
85
87
97
99

TRACTION DEVICE

BACKGROUND OF THE INVENTION

Traction devices which have been used for years by the medical profession are either expensive devices employed in hospitals or cumbersome devices employing weights which may be used in one's home.

SUMMARY OF THE INVENTION

It is an object of the present invention to provide a portable, simple, easy to use, and inexpensive traction device which may be used in hospitals, a physican's office, or in the patient's home.

It is a further object of the present invention to provide a traction device that is readily adjustable and that employs a quick release device to enable the patient to release the traction.

In the preferred embodiment, the traction device comprises a frame adapted to fit about a patient's body. The frame has two telescoping side members and two end members, the latter of which have connecting means adapted to be coupled to the patient's body at two different positions. Means is provided for biasing the telescoping members outward to apply tension to the patient's body. Means is provided to allow the tension to be varied depending upon the need. In addition a quick release device operable by the patient is provided to release the tension.

BRIEF DESCRIPTIO OF THE DRAWINGS

DETAILED DESCRIPTION OF THE INVENTION

Figures 1, 2:
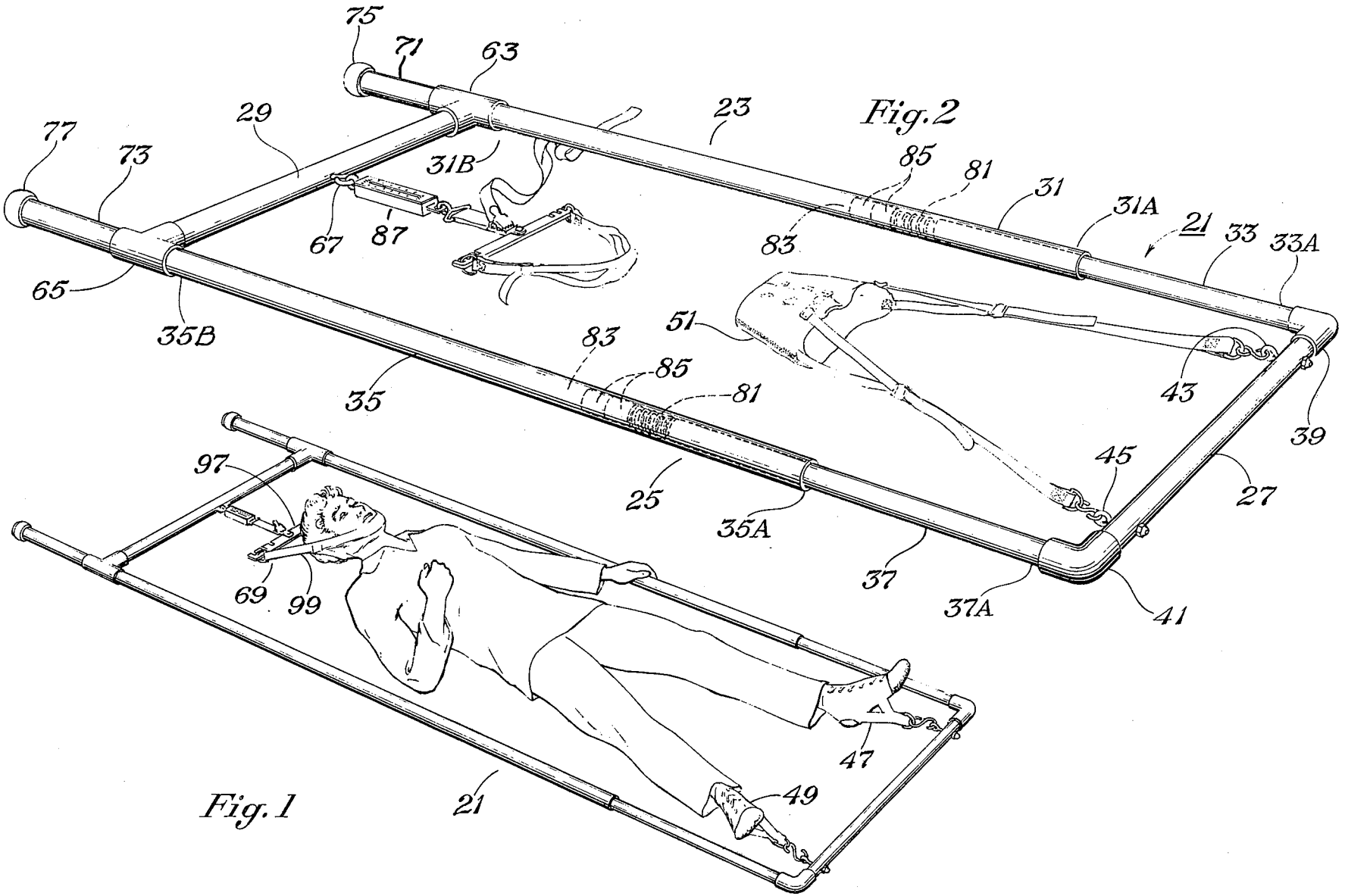
FIG. 1 illustrates the traction device of the present invention fitted about and to a patient.
FIG. 2 is an enlarged view of the traction device of FIG. 1 with the different type of lower body harness attached thereto.

Referring now to the drawings, the traction device of the present invention comprises a rectangular shaped frame 21 adapted to fit about a patient's body while lying down on a bed or the like as seen in FIG. 1. The frame 21 is separate from the bed and forms no part thereof. It comprises two telescoping side members 23 and 25 and two end members 27 and 29. Side member 23 comprises a hollow tubular member 31 having a tubular member 33 of smaller diameter slideably fitted within end member 31 and extending out of its end 31A. Similarly, side member 25 comprises a hollow tubular member 35 having a tubular member 37 of smaller diameter slideably fitted within end member 35 and extending out of its end 35A. The end 33A and 37A of members 33 and 37 are press fitted within the openings of elbows 39 and 41 respectively. The member 27 is a tubular member press fitted within the other openings of elbosw 39 and 41. Eye-bolts 43 and 45 are attached to end member 27 for holding harnesses 47 and 49 for attaching the patient's feet to end member 27 as shown in FIG. 1, or for holding a corset type harness 51 for attaching the patient's hips to end member 27 as shown in FIG. 2. The ends 31B and 35B of members 31 and 35 are press fitted within first openings of hollow of T-members 63 and 65 respectively. The end member 29 is a tubular member and is press fitted within the intermediate openings of T-members 63 and 65. An eye-bolt 67 is attached to end member 29 for holding a harness 69 for attaching the patient's head to end member 29 as shown in FIG. 1 or for holding a different type of harness for attaching the shoulders or the chest of the patient's body to end member 29.

Figure 3:
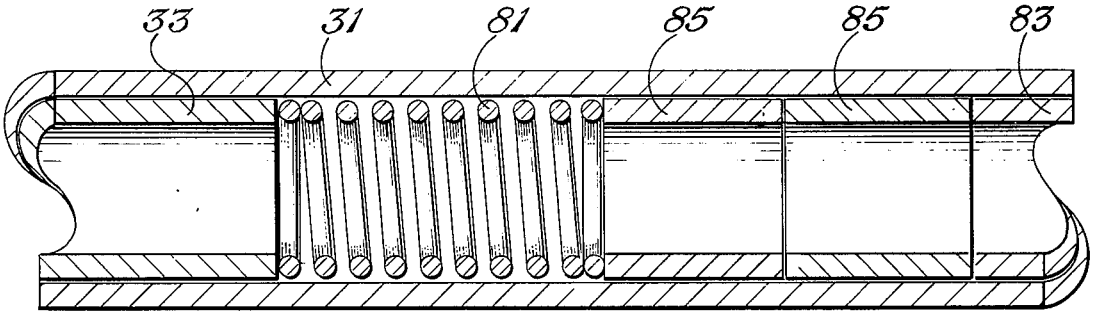
FIG. 3 is an enlarged partial cross section of a portion of the device of FIGS. 1 and 2.

Two short hollow tubular members 71 and 73 are permently attached within the other openings of T-members 63 and 65 respectively. Removable end caps 75 and 77 are threaded to the ends of members 71 and 73. Aligned openings extend through members 71, 63 and 31 and through members 73, 65, and 35. Located within tubular members 31 and 35 are biasing springs and inserts for normally biasing members 33 and 37 outward from members 31 and 35 whereby ends 27 and 29 are normally biased away from each other for applying traction or tension to the patient's body. Each pair of biasing springs and inserts for members 31 and 35 are the same. Reference will be made to FIG. 3 for a description of the biasing spring and insert employed in tubular member 31. In this Figure, the member 31 is shown from a position opposite that of FIGS. 1 and 2 such that slideable member 33 is shown on the left rather than on the right. The biasing spring is a compression spring identified at 81 and the insert is a tubular member identified at 83. Tubular spacers 85 may be located between spring 81 and the end of insert 83. A similar spring 81 and insert 83 will be located in tubular member 35. If spacers 85 are located in tubular member 31, similar spacers will be located in tubular member 35. In FIG. 2 the springs 81, spacers 85 and inserts 83 are shown in dotted form. The inserts 83 are slideably fitted in tubular members 31 and 35 and have ends adapted to engage the end caps 75 and 77 and opposite ends adapted to engage the end of springs 81 or spacers 85 which engage the springs 81 when the patient's lower and upper portions of his body are attached to end members 27 and 29. Thus, when the patient's upper and lower portions of his body are connected to ends 27 and 29, compression springs 81 of the tubular members 31 and 35 engage the ends of members 33 and 37 and the ends of spacers 85 or the ends of inserts 83 and urge the members 33 and 35 and inserts 83 in opposite directions. Since the opposite ends of inserts 83 engage end caps 75 and 77, the ends of members 27 and 29 will be urged in opposite directions to apply traction or tension to the patient's body. The compression strength of each of springs 81 is the same and is predetermined. The amount of traction or tension applied to the patient's body depends on the length of the insert 83 and/or the presence or absence of spacers 85. This is determined solely by the physician or other properly trained practitioner and may be measured by a spring operated scale 87 which is attached to the harness 69. For a patient of a given size, the amount of traction may be increased by using longer inserts 83 or by the use of one or more spacers 85. The traction may be decreased by using shorter inserts 83 or by removing the spacers 85. The inserts 83 and spacers 85 may be inserted into or removed from the tubular members 31 and 35 through members 71 and 73 by removing the end caps 75 and 77.

Figure 4:
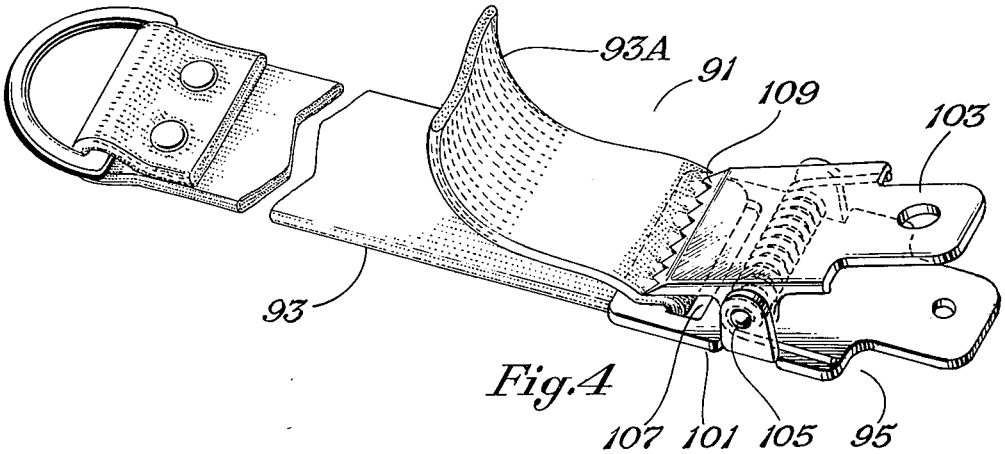
FIG. 4 illustrates in detail the quick release device employed in the traction device of FIGS. 1 and 2.

For convenience and safety, a traction release operable by the patient is provided. It is coupled to the harness 69 and is identified at 91 in FIG. 4. The device 91 comprises a strap 93 having one end coupled to the end of member 29 by way of the scale 87 and an opposite end releaseably coupled to a spring biased clip 95 which in turn is connected to a bar 97 of the hearness 69. A strap 99 is connected to the bar 97 and is positioned around the patient's chin as shown in FIG. 1 or under the patient's arms if the harness is of a different type, for allowing the upper portion of the patient's body to be attached to the end member 29. The clip 95 comprises two plates 101 and 103 pivotally coupled together by way of a pivot pin 105. Plate 101 has an opening 107 formed therethrough for receiving the free end 93A of the strap 93. Plate 103 has teeth 109 formed at one end which are urged against the strap 93 to secure it to the clip 95. The clip 95 may be opened by moving ends 101A and 103A toward each other.

The patient is fitted to the frame by first attaching the lower portion of the body to the end member 27 by way of the selected harness 47, 49 or 51. Having determined the desired length of the inserts 83 and the use or absence of the spacers 85 for a given patient, the harness 69 is attached to the patient and clip 95 is opened and the free end 93A of the strap 93 is inserted through the opening 107. The free end 93A of the strap is then pulled toward member 29 until the desired tension is reached as shown by scale 87. At this point, the clip 95 is closed to allow the teeth 109 to bite into the strap to secure the strap to the clip. If the patient desires to release the traction, he merely has to reach behind him and open the clip 95 with his hand.

Thus, it can be understood that the traction device of the present invention is readily adjustable to accommodate a wide variety of patient sizes and shapes. In the preferred embodiment, the tubular components of the device are formed of PVC whereby they are light weight. Since the members 31, 35 and 29 are press fitted into T-members 63 and 65 and members 33, 37 and 27 are press fitted to elbows 39 and 41, the frame may be readily disassembled to permit transportation in a light weight, compact package. After use, it also may be disassembled completely for proper cleaning and sterilization if desired. Since the device is simply constructed, assembly may be readily accomplished. The device will permit the physician or other practitioner to prescribe the proper amount of traction and to adjust the device so that the patient or other unskilled individual cannot inadvertently apply more than the desired amount of traction. The scale 87 permits the proper amount of traction to be applied, as prescribed by a physician or other properly trained practitioner. It can also be understood that the traction device will accommodate a wide variety of standard harness configurations that will permit the device to be attached to the patient. It is thus capable of applying varying degrees of traction to the cervical and lumbar vertebra, to the pelvic area, and to the lower extremities. The device is equally suitable for use in a hospital, a physician's office, or in the patient's home. Since it is simple, it is easily understood by the patient's so that they may make use of the device upon their own person or with the help of other persons. The harnesses 47, 49 and 51 are lace up type harnesses whereby the patient may himself connect his lower portions to the frame 27 or with the help of others. The patient himself or with the help of others may readily use the upper harness 69 to attach his upper body to the end member 29 as described previously. Also as described previously, the patient may release the traction himself in the event that he desires to do so.

We claim:

1. A traction device for patients comprising:

a portable frame adapted to be fitted about a patient while lying down, said frame comprising two side members and two end members, each side member comprising a tubular member having a second member slideably located therein and extending out of a first end thereof, each of said second members of said side members having an end connected to one of said end members, each of said tubular members having a second end opposite said first end thereof connected to the other of said end members, each of said end members having connecting means adapted to be coupled to the patient's body at two different positions respectively when said frame is fitted about the patient, removable means located in each of said tubular members, said removable means in each tubular member having a first end spaced from said second member and a second end adapted to engage said second end of said tubular member, biasing means located in each of said tubular members between its second member and its removable means for biasing its second member and its removable member in opposite directions for biasing said two end members in opposite directions for applying tension to the patient's body between said two portions to which said connecting means are coupled, one of said connecting means comprising an upper body connecting means coupled to one of said end members and adapted to be coupled to the upper portion of the patient's body, said upper body connecting means comprising:

a scale for measuring the tension applied to the patient's body, and a strap adapted to be coupled between said one end member and the upper portion of the patient's body by way of a quick releaseable clip adapted to be operated by the patient to allow the patient to readily disconnect the upper portion of the patient's body from said one end member to release the tension.

2. A traction device for patients, comprising:

a portable frame adapted to be fitted about a patient while lying down, said frame comprising two side members and two end members, each side member comprising a tubular member having a second member slideably located therein and extending out of a first end thereof, each of said second members of said side members having an end connected to one of said end members, each of said tubular members having a second end opposite said first end thereof connected to the other of said end members, each of said end members having connecting means adapted to be coupled to the patient's body at two different positions respectively when said frame is fitted about the patient's body, biasing means for biasing said tubular members and said second members in opposite directions for biasing said two end members in oppposite directions for applying tension to the patient's body between said two positions to which said connecting means are coupled, one of said connecting means comprises an upper body connecting means coupled to one of said end members and adapted to be coupled to the upper portion of a patient's body, said upper body connecting means comprising:

a scale for measuring the tension applied to the patient's body, and a strap adapted to be coupled between said one end member and the upper portion of the patients body by way of a quick releaseable clip adapted to be operable by the patient to allow the patient to readily disconnect the upper portion of the patient's body from said one end member to release the tension.

* * * * *